US005421639A

United States Patent [19]

Bartholomew

[11] Patent Number: 5,421,639

[45] Date of Patent: Jun. 6, 1995

[54] LIFTING DEVICE FOR INVALIDS

[76] Inventor: James R. Bartholomew, 233 Pennington - Rocky Hill Rd., Pennington, N.J. 08534

[21] Appl. No.: 243,245

[22] Filed: May 16, 1994

[51] Int. Cl.[6] ..... A47C 7/62; A47C 7/00; A47C 31/00

[52] U.S. Cl. ..... 297/217.1; 297/130; 297/354.1; 297/DIG. 10; 297/183.1; 297/83.8; 297/378.1; 5/86.1

[58] Field of Search ..... 297/217, DIG. 10, 366.1, 297/354.1, 344.12, 344.18, 344.19, 130, 183, 378.1; 5/86.1, 83.1; 248/188.7

[56] References Cited

U.S. PATENT DOCUMENTS

| | | | |
|---|---|---|---|
| 3,310,816 | 3/1967 | James et al. | 5/83.1 |
| 4,229,039 | 10/1980 | Day | 297/183 |
| 4,640,525 | 2/1987 | Jensen et al. | 297/130 |
| 4,744,536 | 5/1988 | Bancalari | 248/188.7 |

*Primary Examiner*—Peter R. Brown
*Assistant Examiner*—Anthony Barfield
*Attorney, Agent, or Firm*—Daniel E. Kramer

[57] ABSTRACT

A portable, storable lifting device for invalids. The device includes a jack base having a backwardly inclined jack upright on which is mounted a jack platen including a hook. Forward and rearward facing wheeled legs are provided attached to the jack base. Each forward facing leg is hinged to the jack base though a universal joint thereby allowing the legs to be folded into a compact position for transportation or storage. A segmented lever is provided. A folding seat is provided having a back hinged to a bottom. Strap means are attached to the seat bottom and to the seat back for securing to the seat both the upper and lower torso of a fallen invalid who is positioned prone on a floor surface. The seat includes dual function means attached to the back, both for using the segmented lever to provide leverage to the seat, whereby the prone invalid is rotated to an upright sitting position, and for engaging the jack hook, whereby the seat containing the prone invalid is raised above the floor with the invalid in an upright sitting position.

7 Claims, 3 Drawing Sheets

LIFTING DEVICE FOR INVALIDS

FIELD OF THE INVENTION

The present invention relates to devices for raising and moving invalids and disabled persons. The invention further relates to such devices that are adapted to allow infirm or weak caretakers to control and lift heavy patients who are prone on the floor. The invention further relates to such devices which include seats designed to achieve the above objectives. The invention further relates to such devices which can be folded for easy transportation and storage.

BACKGROUND OF THE INVENTION

In this specification, persons in a position to need the device described herein will be referred to as she. The reader should understand that there is no intent to suggest that women are any more likely to suffer from falls or other mishaps than men and that the pronoun 'she' is intended to refer to persons of either gender and is used to simplify the textual references without causing offense to people of either gender.

Improved diets, greater self interest, wider dissemination of health related information, more exercise, better weight control, reduced smoking, safe work-places, better product labeling and improved medical care have all contributed to sharply increased longevity of many people. Couples who have been married fifty or more years are increasingly common. While life has been prolonged, periods of ill health and infirmity are not uncommon.

Older persons who fall, though not injured, are frequently unable to arise from the prone position without the help of a strong person. If injured, of course, without assistance of several strong persons, a prone person cannot easily be elevated to a seat or bed.

RELATED ART

The medical catalogs show many devices in the nature of lifts and cranes to assist healthy strong nurses and their helpers to transfer invalids from one environment to another, eg, from a chair to a bed or bath, or from a bed to a commode. All of these devices are costly, heavy and hard to transport. Some are designed to be permanently fastened to walls or ceilings. All are sturdily built and intended for frequent use by professionals. Because they are intended for frequent use in hospital or nursing home environments, low cost, light weight, compactness and storability have been accorded low priority.

The catalog of Oxford Lifts of Gallatin, Tenn. shows a lift having a wheeled fork-like base employing legs with limited outward pivoting capability. The lift employs a hydraulic cylinder to raise and lower an arm extending between the fork legs. A pivot at the end of the arm allows a seat (not shown) to turn in any direction. Oxford also shows a screwed-to-the-floor lift employing a hand operated screw to raise and lower an arm to which a rigid bottom—back seat assembly is attached. The Oxford hydraulic lifts have available an electric pump for actuating their hydraulic cylinder.

The Hoyer Company of Oshkosh, Wis. offers lifts similar to the Oxford lifts. All the Hoyer lifts appear to employ a cloth sling with chest strap for lifting.

The advertisement of the Columbus McKinnon Corp. of Amherst, N.Y. shows a sliding track long enough to span a large double bed. The track is supported about eight feet off the ground and parallel to it by a pair of inverted tee-shaped vertical members. The ends of the two tee-tops are wheeled for mobility. An electrically actuated hoist raises and lowers a cloth sling with a chest strap.

None of the described devices appear adapted to engaging, rotating and lifting a person in a prone-on-the-floor position, nor capable of folding for compact transportation and storage.

OBJECTS AND ADVANTAGES

The present invention is directed toward providing a light weight portable lift which is adapted to enabling a fragile, not-strong person to pick up off the floor a heavy disabled person.

It is an objective of the present invention to provide an attachment between the front legs and the base which allows easy movement of the legs from a strong operating/hoisting position to a compact folded-up position both for storing and for transporting.

It is a further objective to provide a hoist construction where the upright is tilted at an oblique angle from the front legs, thereby improving the hoist stability during the lifting process.

It is a further objective of the present invention to provide a hoist which can be actuated by a common power wrench or power screwdriver.

It is a further objective to provide a hoist including a seat having leverage arrangements to allow a prone person to be rotated to an upright sitting position.

It is a further objective to provide a hoist including a seat which includes means for alternately providing legs or casters.

It is further objective to provide a hoist having a seat having the above advantages, where the seat also folds compactly for storage.

It is a further objective of the invention to provide a hoist having a seat, where the seat includes means for lifting from an overhead hoist, not of the invention.

It is a further objective to provide a hoist including a seat having a rotating member portion of the seat bottom.

It is a further objective to provide hoist having a hook for engaging the seat and to provide a hook-seat engagement which provides angular stability, thereby preventing undesired seat rotation during the lifting process.

Other advantages and objectives will become apparent as the details of the invention are revealed.

SUMMARY OF THE INVENTION

Most simply the invention comprises a lift having a backward tilting upright mounted on a base having spread apart forward facing wheeled legs which are adapted to be folded compactly for storage and transportation. Slidingly mounted on the upright is a platen having a lifting hook securely attached. A seat is provided with two pairs of straps for attachment to a prone disabled person for rotating the person to an upright position and for subsequent lifting. The seat has a substantially rigid bottom and a substantially rigid back attached thereto. Segmented multi-function lever means are provided. A dual function tubular fitting is attached to the seat back. The fitting coacts with the lever, whereby a prone person secured to the seat is easily rotated to an upright position. The fitting also provides engagement for the lifting hook of the lift, whereby the prone person, having been levered to an upright position, is easily lifted to a desired height.

BRIEF DESCRIPTION OF THE DRAWINGS

The foregoing summary, as well as the following description of the preferred embodiments, will be better understood when read in conjunction with the appended drawings. For the purpose of illustrating the invention, there is shown in the drawings an embodiment which is presently preferred, it being understood, however, that the invention is not limited to the specific instrumentalities or the precise arrangement of elements disclosed.

DETAILED DESCRIPTION OF THE INVENTION

Figure 1:
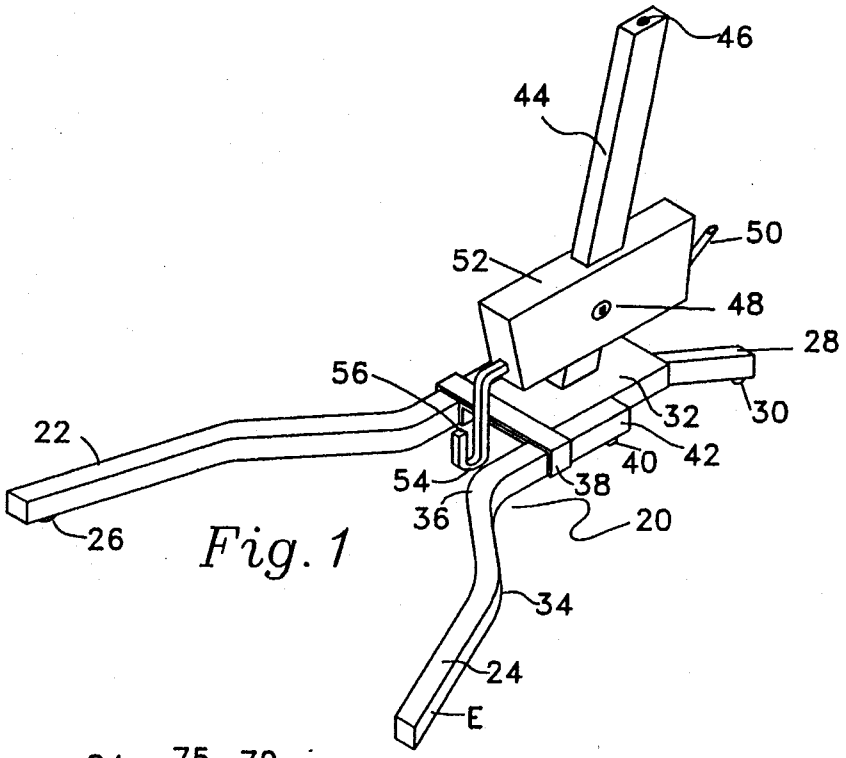
FIG. 1 is an isometric view of the lift.

Referring now to the drawings, wherein like references are used to indicate like elements, there is shown in FIG. 1 an isometric view of the lift 20 of the invention. Main base 32 is formed of heavy gage steel or aluminum. The base has a front in the direction of hook 54 and a rear. At the rear are positioned a pair of legs 28 protruding from base 32 at about 45 degrees each side of a base centerline. The rear legs 28 are formed of a single piece of tubing bent into an approximate right angle and bolted or welded to the interior of the rear of the base 32. Though rectangular tubing is shown in FIG. 1, round tubing can be substituted. Front legs 22 and 24 are attached to the sides of base 32.

Figure 12:
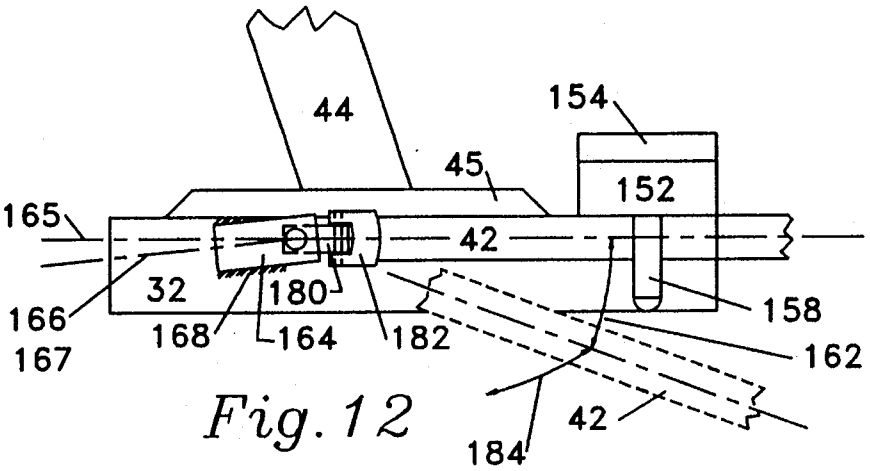
FIG. 12 illustrates a side view of an embodiment of the invention where the front legs are fastened to the base through a universal joint.
Figure 13:
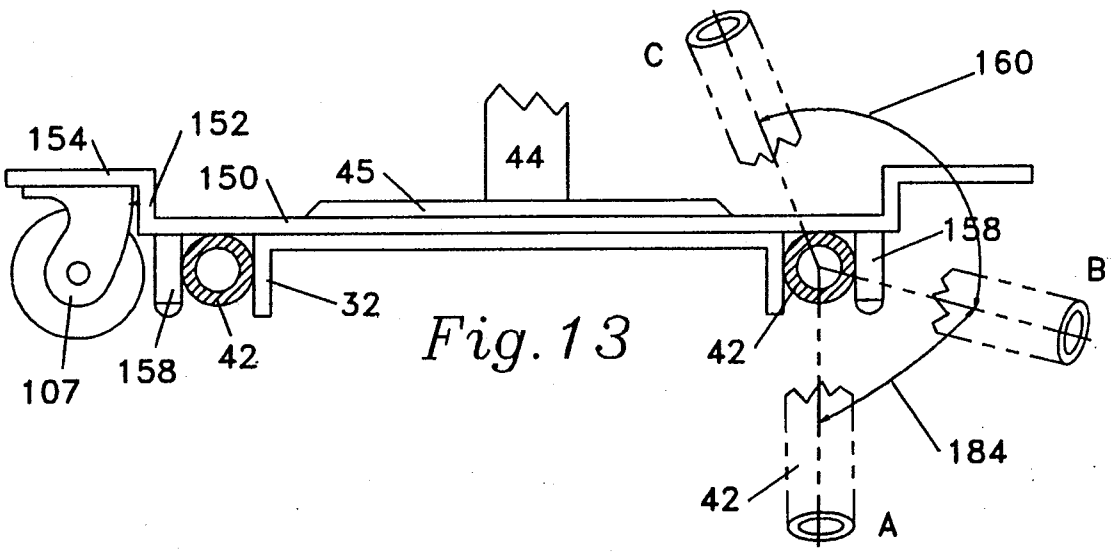
FIG. 13 illustrates a front view of the embodiment of FIG. 12 showing the path taken by a leg during the folding process.
Figure 9:
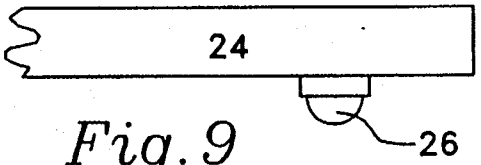
FIG. 9 shows a leg of the lift with a ball type caster.

In the preferred embodiment, details of which are shown in FIGS. 12 and 13, the base or rear end 42 of each of the front legs 22,24 is fastened to an opposite side of base 32 through a universal joint 164. The universal joint 164 has a stationary portion attached by weld 168 to base 32. The stationary part has a center line 166 which is rotated downward to the rear. Link 180 and end 182 of the universal joint 164 are connected to stationary part by pins positioned at right angles to each other. The universal joint 164 allows the front legs 22,24, to be positioned as shown in FIG. 1 for lifting, and as shown in FIGS. 12 and 13 where the rear or base portion of the front legs are identified as 42, to be rotated easily downward through positions A and B to folded position C. The path of rotation is via arc 162 (FIG. 12), outward away from base 32 through arc 184, and upward toward upright 44 through arc 160 (FIG. 13) for easy storage and transportation. Pin 158 secured to front leg retaining bracket 150, retains the base end 42 of front leg 24 in lifting position. The offset 152, 154 in the front leg retaining bracket 150 provides room for caster 107, while allowing the lift legs and base to be close to the floor. Referring again to FIG. 1, bracket 38 retains the front legs 22,24 in position for lifting. Supplementary rolling support in the form of ball 40 is shown on the underside of the base end 42 of each of the front legs.

Figure 10:
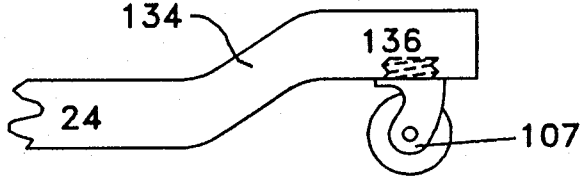
FIG. 10 shows a side view of another embodiment of the lift leg utilizing an offset to provide room for a caster.

The front legs have a double bend 34,36 to provide a wide entry for a seat. Each end E of the front legs is equipped with a rolling device such as a ball caster 26 or a wheeled caster 107 of the type illustrated in FIG. 7. Where a wheeled caster 107 is employed, the leg construction of FIG. 10 is employed. In FIG. 10 the leg 24 is formed with a double bend 134 to provide operating height for the caster while allowing the leg 24 to reside close to the floor for stability and ease of engaging the seat.

Figure 3:
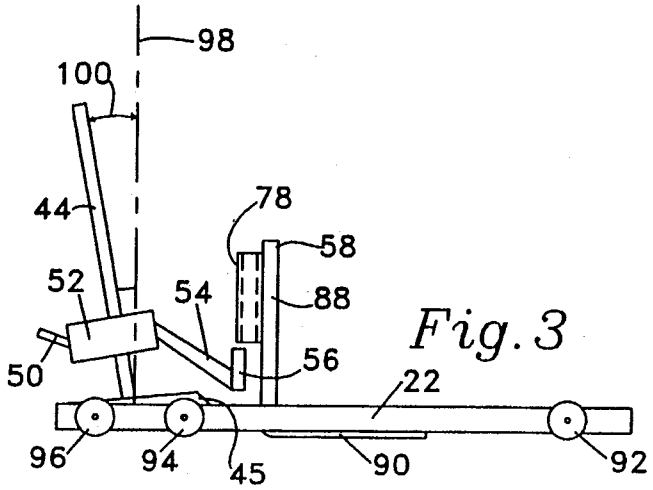
FIG. 3 is a side elevation of the lift with backward tilted upright.
Figure 4:
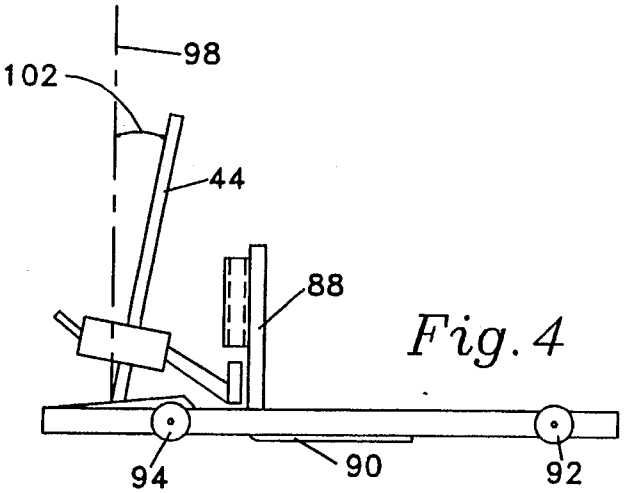
FIG. 4 is a side elevation of the lift with forward tilted upright.

Upright 44 is rigidly fastened into main base 32. Referring to FIG. 3 for clarity, upright 44 is positioned at an obtuse angle with the portion of the plane of front legs 22,24 ending at the base 32. The obtuse angle is shown, for clarity, as the angle of the perpendicular 98 to the plane of the front legs 22,24 plus the angle 100 between the upright 44 and the perpendicular 98. An alternative embodiment of the invention is shown in FIG. 4 where the upright is positioned at an acute angle with the plane of front legs 22,24. In FIG. 4 the acute angle is shown as the angle of the perpendicular 98 to the plane of the front legs less the angle 102 between the upright 44 and the perpendicular 98.

Both FIGS. 3 and 4 show the seat 58 positioned between front legs 22,24 in a position to be engaged by lifting hook 54,56. Lifting hook 54,56 is attached to platen 52 in a position to engage dual function fitting 78 which is fastened to the back 88 of seat 58.

Platen 52 is slidably mounted on upright 44. In the preferred embodiment, the internal mechanism of platen 52 is actuated by inserting a lever into the open end of socket 50 and moving socket 50 in a reciprocating up and down motion, whereby the platen 52 is raised or lowered. In an alternate embodiment of the invention, socket 48 is available to actuate the lifting mechanism by inserting the male portion of a power screwdriver. In another alternate embodiment, the platen 52 is raised and lowered by an Acme screw traversing the length of upright 44 and accessed by fitting 46 which is positioned at the top end of the upright 44. Fitting 46 can be manually turned by a crank or by an electrical actuator such as power screwdriver. An alternate embodiment of the invention provides a hydraulic cylinder for lifting positioned within upright 44, actuated by a hand pump having external pump lever 50.

Figure 2:
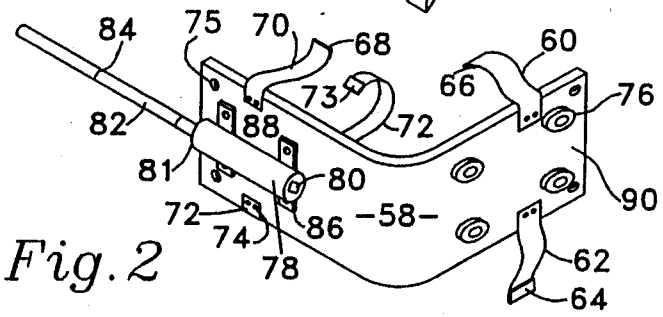
FIG. 2 is an isometric view of one embodiment of the seat showing a tubular fitting attached to the seat back, with lever inserted.

Referring now to FIG. 2, seat 58 has bottom 90 and back 88. Seat bottom 90 has fastened to it right side lap belt 60 having a loop portion 66 of a hook—loop fastener securely positioned at the end. Seat bottom 90 has fastened to it left lap side belt 62 having a hook portion 64 of a hook—loop fastener securely positioned at the end. Seat back 88 has fastened to it right side chest belt 70 having a hook portion fastener 68 and left side chest belt 72 having a loop portion fastener 73. With this arrangement of alternate hook—loop portions on each side, the belts are capable of being connected right side to right side for lifting from an overhead hoist, or as normal chest and lap belts.

Figure 6:
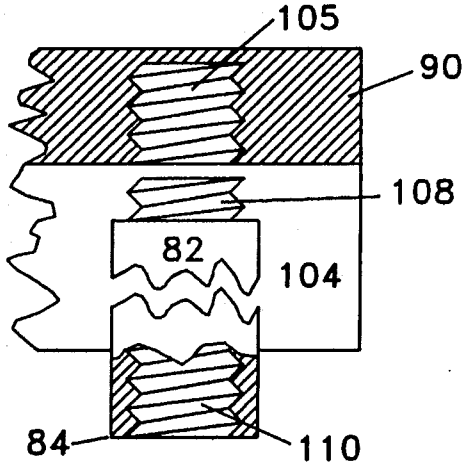
FIG. 6 is an elevational view in partial cross-section of a portion of the seat bottom having a threaded hole and a lever segment adapted to screw into the threaded hole.

Attached to the back 88 of seat 58 is a fitting 78 which is in the form of a tubular structure open at both ends positioned substantially perpendicular to the seat bottom 90 and with its upper end adjacent, the top of seat back 88. In the preferred embodiment, the lower end has a square opening 80 whose dimension is selected to allow easy entry of the square end 56 of lifting hook 54. The use of the square cross-section allows the seat to be lifted without fear of seat rotation and resultant lift instability. The upper end 81 of fitting 78 is adapted to easily accept a lever, which in the preferred embodiment of the present invention is formed from four screwed-together segments 82 having one end provided with a threaded male portion 108 and the other end provided with a mating threaded female portion 110 as shown in FIG. 6. In an alternate embodiment, fitting 78 is formed into the back 88 of the seat 58 as by molding.

In actual use to lift a prone immobile patient or victim, bottom 90 of seat 58 is positioned adjacent to the buttocks of the victim, the lap belts 60 and 62 are fastened together around the victim; seat back 88 is positioned adjacent the back of the victim and chest belts 70 and 72 are securely fastened around the victim. Then lever 82 is inserted into the open upper end 81 of fitting 78 and the seat 58 is rotated to an upright position employing the mechanical advantage provided by lever 82. In the preferred embodiment, ball type casters 76 are positioned on the exterior of seat bottom 90 to allow the victim, now seated in an upright position, to be easily rolled into a position between the front legs 22,24 of the lift 20.

Seat 58 has holes 75 at the outer corners of the seat bottom 90 and the seat back 88 to allow lifting the seat by an external hoist (not shown) equipped with hooks.

Figure 5:
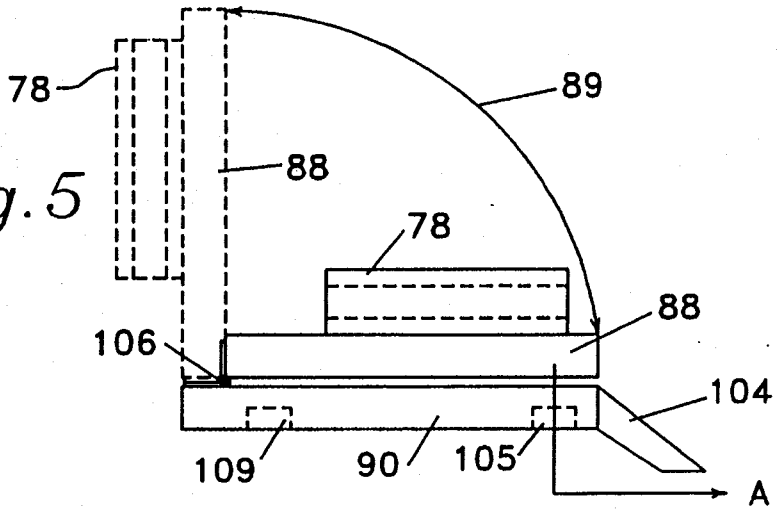
FIG. 5 is a side view illustrating the construction of a folding seat.

FIG. 5 is a side view of an embodiment of the seat having hinge 106 positioned to allow rotation of the seat back 88 with respect to the seat bottom 90 through arc 89. This feature allows the seat to be folded for compact storage or transportation. Lip 104 is provided to allow the seat to be slid under the victim when the seat bottom is elevated off the floor by casters.

FIG. 6 is a partial section of seat bottom 90 showing threaded socket 105 with the threaded male end 108 of lever segment 82 positioned to be screwed into position as a seat leg.

Figure 8:
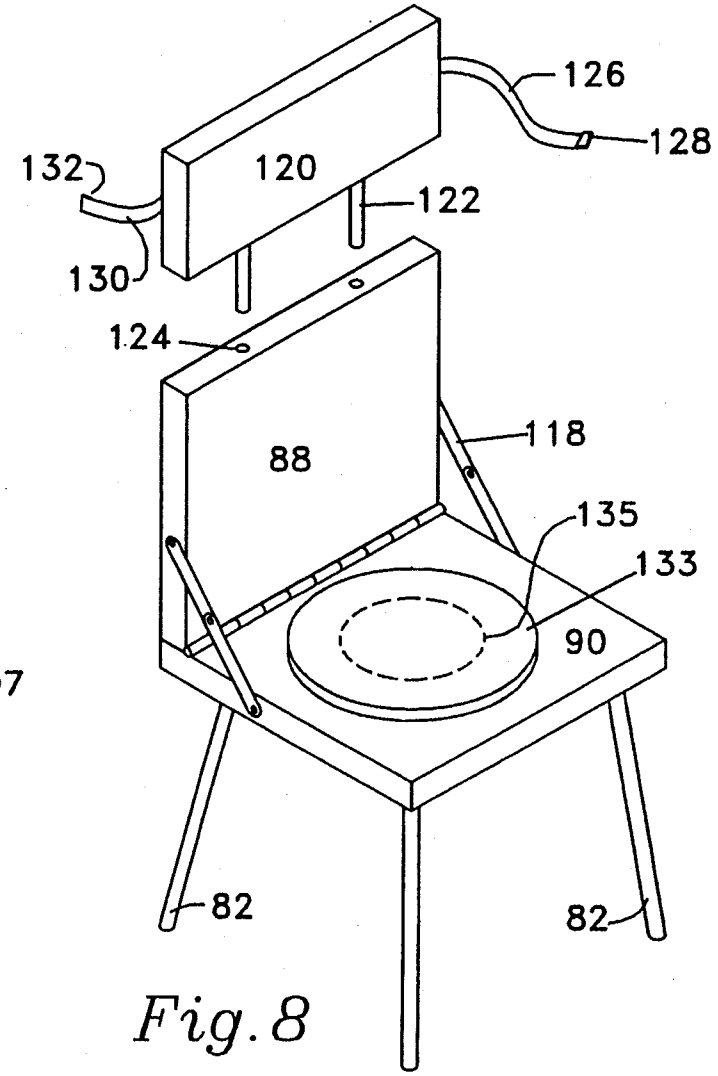
FIG. 8 shows a folding seat with head rest and lever segments installed as seat legs.
Figure 7:
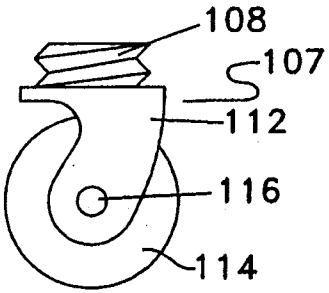
FIG. 7 is a view of a caster suitable for screwing into the seat bottom or leg end.

FIG. 7 shows a caster 107 having a male threaded portion 108 which can be screwed into threaded seat socket 105 or into the threaded female socket 110 in the end of lever element 82. Referring to FIG. 8, the casters, so positioned at the floor end of legs 82, provide an easily assembled wheeled chair.

FIG. 8 is an isometric representation of the seat of the invention including toggle braces 118. A head rest 120 with head straps 126 and 130 are provided to secure the head of an unconscious person to prevent neck injury. Head rest 120 is mated with seat back 88 by way of male pins 122 which are inserted into corresponding holes 124 formed in the top of the seat back. Legs 82 are formed from lever segments which have been unscrewed from each other and screwed into threaded sockets 105 in seat bottom 90 for the purpose. Turntable 133 is substantially centrally located on seat bottom 90 and is provided for allowing rotation of the seated victim. Turntable 133 is removeable, thereby providing access to hole 135 in seat bottom 90, for toilet use.

Figure 11:
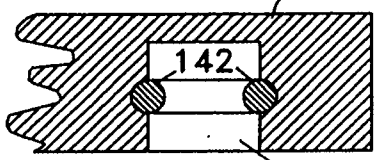
FIG. 11 shows a seat bottom with a non-threaded hole including an O-ring insert for securing the lever segment in place
Figure 11:
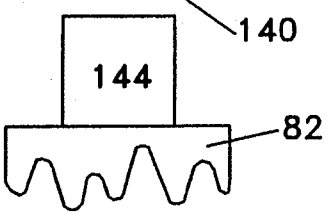

An alternate construction to threading sockets in the seat bottom is shown in FIG. 11 where the smooth male ends 144 of lever segments 82 are held in place by frictional effect of O-ring 142 which is inserted in a corresponding groove in smooth socket 140.

It is an objective of the backward tilting upright 44 of FIG. 3 to move the center of gravity of the invalid in a direction away from its initial position between the front legs 22, 24 and backward toward the base 32 and upright 44, as the invalid is lifted off the floor, in order to provide greater stability of the loaded lift during the final stages of the lifting operation and during any subsequent move.

From the foregoing description, it can be seen that the present invention comprises an improved lift assembly usable by an infirm or weak person for lifting a disabled person from a prone position on the floor. It will be appreciated by those skilled in the art that changes could be made to the embodiments described in the foregoing description without departing from the broad inventive concept thereof. It is understood, therefore, that this invention is not limited to the particular embodiment or embodiments disclosed, but is intended to cover all modifications which are within the scope and spirit of the invention as defined by the appended claims.

I claim:

1. Lift means for raising a prone disabled person, said lift means comprising; a base having a front and a rear, two short wheeled legs extended rearward from the base rear, two long wheeled legs extending forward from the base front, the forward extending legs residing in a plane ending at the base, and an upright having a central axis, the upright extending upward from the base and positioned so that its axis and the plane of the front legs form an obtuse angle, and further providing a platen having a forwardly extending lifting hook attached, the platen being slidably mounted on the upright, and mechanically advantaged means for moving the platen up and down the upright; seat means comprising; a substantially rigid seat bottom having a right side and a left side, a substantially rigid seat back having a top edge, a right side and a left side; further providing hinge means for rotatably joining the bottom with the seat back; seat securing means each having a free end and a secured end, the securing means comprising a left bottom strap secured to the left side of the seat bottom, the left bottom strap having a hook fastener at its free end, a right bottom strap secured to the right side of the seat bottom, the right bottom strap having a loop fastener at its free end; a left back strap secured to the left side of the seat back, the left back strap having a loop fastener at its free end, and a right back strap secured to the right side of the seat back, the right back strap having a hook fastener at its free end, whereby in a first case the left and right bottom straps can be fastened together and the left and right back straps can be fastened together and a second case where the two left straps can be fastened together and the two right straps can be fastened together; lever means having an outside diameter, and tubular means having an upper open end and a lower open end, the tubular means having an inside diameter smaller than the outside diameter of the lever means, the tubular means being attached to the seat back and positioned substantially perpendicular to the seat bottom and with its upper open end adjacent the top of the seat back and, for providing the dual functions of coacting with the lever means when the lever means is inserted into the upper end of the tubular means, whereby the seat can be rotated from a position on its sides to a position on its bottom, and for coacting with the lifting hook of the lift means when the hook is inserted into the lower end of the tubular means, whereby the seat is easily lifted to a desired height, and further providing that the seat bottom includes a rotatable member positioned substantially centrally on the seat bottom.

2. Lift means as recited in claim 1 further providing a hole centered in the seat bottom beneath the rotatable member, thereby providing a commode function on removal of the rotatable member.

3. Lift means for raising a prone disabled person, said lift means comprising; a base having a front and a rear, two short wheeled legs extended rearward from the base rear, two long wheeled legs extending forward from the base front, the forward extending legs residing in a plane ending at the base, and an upright having a central axis, the upright extending upward from the base and positioned so that its axis and the plane of the front legs form an obtuse angle, and further providing a platen having a forwardly extending lifting hook attached, the platen being slidably mounted on the upright, and mechanically advantaged means for moving the platen up and down the upright; seat means comprising; a substantially rigid seat bottom having a right side and a left side, a substantially rigid seat back having a top edge, a right side and a left side; further providing hinge means for rotatably joining the seat bottom with the seat back; seat securing means each having a free end and a secured end, the securing means comprising a left bottom strap secured to the left side of the seat bottom, the left bottom strap having a hook fastener at its free end, a right bottom strap secured to the right side of the seat bottom, the right bottom strap having a loop fastener at its free end; a left back strap secured to the left side of the seat back, the left back strap having a loop fastener at its free end, and a right back strap secured to the right side of the seat back, the right back strap having a hook fastener at its free end, whereby in a first case the left and right bottom straps can be fastened together and the left and right back straps can be fastened together and a second case where the two left straps can be fastened together and the two right straps can be fastened together; lever means having an outside diameter, and tubular means having an upper open end and a lower open end, the tubular means having an inside diameter smaller than the outside diameter of the lever means, the tubular means being attached to the seat back and positioned substantially perpendicular to the seat bottom with its upper open end adjacent the back top, whereby the tubular means provides the dual functions of: coacting with the lever means when the lever means is inserted into the top end, whereby the seat can be rotated from a position on its sides to a position on its bottom, and for coacting with the lifting hook of the lift means when the hook is inserted into the lower end of the tubular means, whereby the seat is easily lifted to a desired height, and further providing at least three recesses having retaining means, the recesses being positioned in the seat bottom whereby accessories can be rigidly inserted and retained and further providing that the lever comprises at least three separable segments, the segments being adapted, when separated, to be inserted into and retained within the seat bottom recesses as legs.

4. Lift means for a prone disabled person said lift means comprising a base having a front and a rear, two short wheeled legs extended rearward from the base rear, two long wheeled legs extending forward from the base front, the forward extending legs residing in a plane ending at the base, and an upright having a central axis, the upright extending upward from the base and positioned so that its axis and the plane of the front legs form an obtuse angle, and further providing a platen having a forward facing lifting hook attached, the platen being slidably mounted on the upright, and further providing mechanically advantaged means for moving the platen up and down the upright seat means comprising; a substantially rigid seat bottom joined to a substantially rigid seat back; bottom strap means for securing the prone person to the seat bottom, back strap means for securing the prone person to the seat back, lever means, and substantially tubular means attached to the seat back for coacting with the lever means when said lever means are inserted into the tubular means, whereby the seat is easily rotated from a position on its side to a position on its bottom, and for coacting with the lifting hook of the lift means when the lifting hook in inserted into the tubular means, whereby the seat is easily lifted to a desired height.

5. Lift means as recited in claim 4 further providing hinge means for rotatably joining the seat back with the seat bottom.

6. Lift means as recited in claim 4, further providing at least three recesses having retaining means, the recesses being positions in the seat bottom whereby accessories can be rigidly inserted and retained.

7. Lift means as recited in claim 6 further providing that the lever comprises at least three separable segments, the segments being adapted, when separated, to be inserted into the seat bottom recesses as legs.

* * * * *